United States Patent [19]

Deyo

[11] 4,434,860

[45] Mar. 6, 1984

[54] HOIST PULL DOWN SYSTEM FOR BLAST HOLE DRILL

[75] Inventor: Bruce Deyo, Columbus, Ohio

[73] Assignee: Dresser Industries, Inc., Dallas, Tex.

[21] Appl. No.: 326,470

[22] Filed: Dec. 2, 1981

[51] Int. Cl.[3] ..... E21B 15/00; E21B 19/08

[52] U.S. Cl. ..... 173/147; 474/110

[58] Field of Search ..... 173/147, 28; 474/110, 474/113, 117, 136–138; 254/277

[56] References Cited

U.S. PATENT DOCUMENTS 3,867,989 2/1975 Hisey et al. ..... 474/110 X

OTHER PUBLICATIONS

"Blast Hole Drill, Descriptive Information," Marion Power Shovel, publication Cl-930.

"GD-120 (Blasthole Drill) Maintenance Instruction," Gardner-Denver Co., Bulletin 29-259-First Edition.

Parts Catalog BE 6074, 6166, Bucyrus-Erie Co.

*Primary Examiner*—James M. Meister

*Attorney, Agent, or Firm*—John M. Lorenzen

[57] ABSTRACT

A chain-type hoist pull down system for a large blast hole drilling rig is provided which includes an auxiliary tensioning mechanism to increase the tension of the pull down chain during selected operating modes. In the preferred embodiment the auxiliary tensioning mechanism comprises a single acting hydraulic cylinder suspended between an idler sprocket and a spring loaded resilient mounting. A simple circuit for automatically actuating the auxiliary tensioning mechanism at the required time is also provided.

12 Claims, 7 Drawing Figures

49
44
23
48
46
45
11
23
11
38
36
36
11
15
14
14
9
15
19
39
39
54
54
53
60
52
60
51
34
52
65
12
26
50
26

HOIST PULL DOWN SYSTEM FOR BLAST HOLE DRILL

The present invention relates generally to drilling rigs and particularly to very large blast hole drills. Specifically, it concerns an improved chain-type, hoist pull down system for raising and lowering the drill pipe on such a drill.

The typical blast hole drill has a head which includes a rotatable chuck for gripping the end of a drill pipe and which is mounted for travel up and down a vertical mast. The head engages the drill pipe and either forces it down into the drill hole or alternatively lifts it back out. In smaller drill rigs, the mechanism for moving the drill head up and down can be a simple system of hydraulic cylinders. On some larger rigs, a rack and pinion system is used. However, for the very large drill rigs, due to the length of travel, a chain-type pull down system offers maintenance and economic advantages.

In a chain-type system, a long power transmission chain, typically a roller chain, is connected at one end to the top of the drill head. The chain is reeved around idler sprockets mounted at the top and bottom of the mast and its other end is connected to the bottom of the drill head. The chain is also engaged by a drive sprocket which in turn is connected to a reversible motor or gearbox. Thus, depending on the rotational direction of the drive sprocket, the chain is moved to either pull down on the drill head during the drilling operation, or up on the drill head when pulling pipe out of the hole.

Because of its great length and the large tensile loads imposed on it during the drilling or pulling operation, the chain will stretch. This elastic stretch must be compensated for by some, preferably self-acting, take-up mechanism. One proven means is to provide one or more resiliently mounted idler sprockets in the chain circuit. Permanent stretch in the chain is compensated for by a turnbuckle provided somewhere along its length. These compensating devices are generally satisfactory for maintaining the chain taut when the rig is operational for drilling and there is a substantial load on the chain.

However, when the drill rig is traveling between jobs, or setting its leveling jacks, there is no load on the chain other than the dead weight of the drill head. Thus, the chain becomes slack and its long spans between sprockets whip around due to jostling of the mast or high winds. The chain can slap against the chain guards or various parts of the mast and cause damage to itself or these parts.

It is therefore an object of the present invention to provide a chain-type hoist pull down system for a large blast hole drill which includes means for temporarily increasing the tension in the chain when the drill is in a non-drilling mode, such as during travel, to maintain the chain taut and stable.

It is a further object of the invention to provide such a system in which the auxiliary tensioning means is simple, inexpensive, efficient, and automatically actuated when needed.

In accordance with the present invention there is provided a chain-type, hoist pull down system which meets these objectives. The system includes means interposed between an idler sprocket and its resilient mounting for selectively imposing an additional tensile load in the pull down chain. In the preferred embodiment described below, the auxiliary tensioning means comprises a fluid-actuated cylinder. The cylinder base is mounted on a floating bracket which is connected against springs to the mast. The rod end of the cylinder is connected to an idler sprocket engaging the chain.

When the drill rig is in the operative mode for drilling the cylinder is retracted and the tension in the chain consists of that contributed by the spring loaded idler sprockets, the weight of the drill head, and the load imposed by the drill string. In the other operative modes, such as during travel or rig leveling, when the chain is unloaded the cylinder is actuated and extended to impart additional tension on the chain to prevent it being too slack.

It is a further feature of the invention that the auxiliary tensioning means is automatically actuated when the operator selects an operative mode other than for drilling, and automatically deactuated when he selects the drilling mode.

These and other features of the invention will be more readily apparent from the more detailed description of the preferred embodiment which follows with reference to the acompanying drawings, which form part of this disclosure, and of which:

Figure 1:
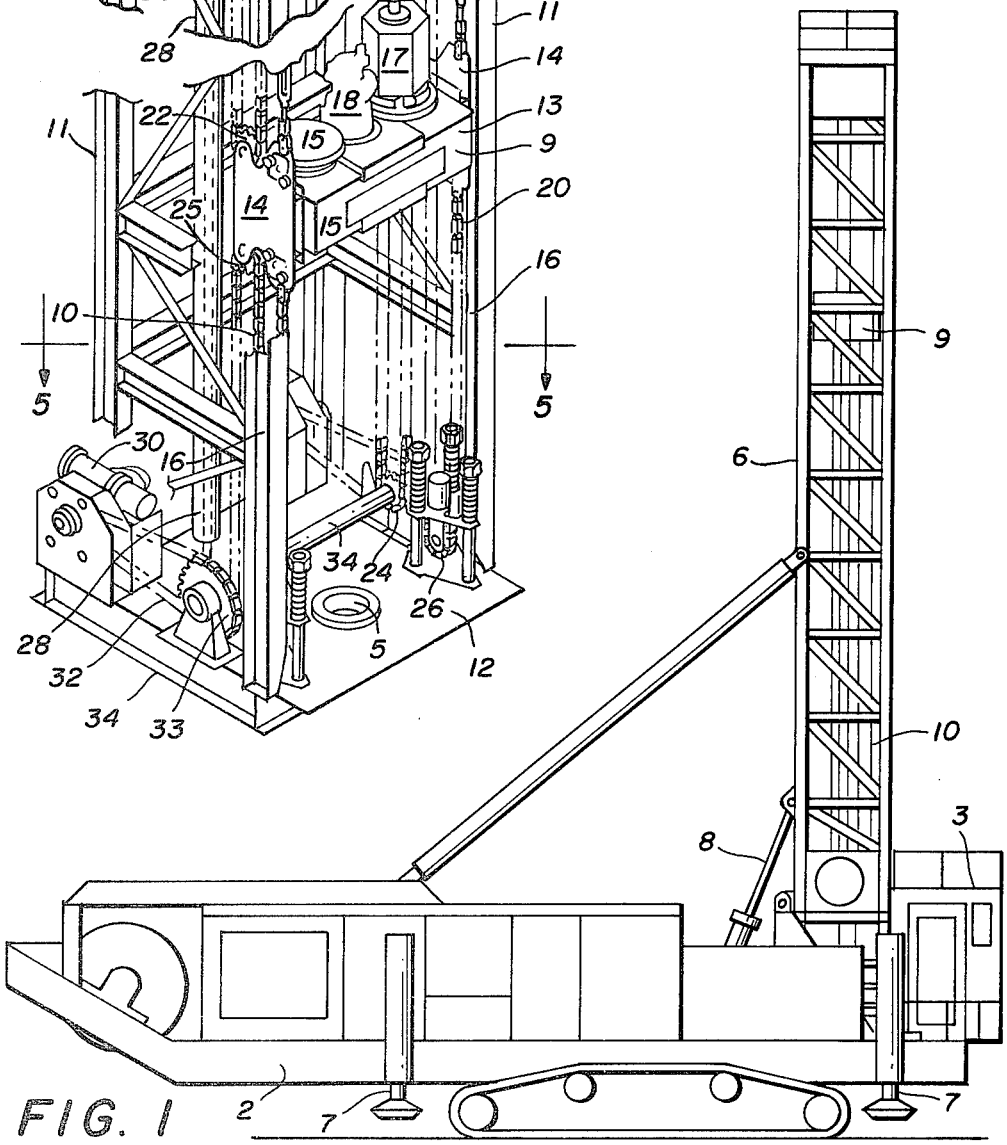
FIG. 1 is a side elevational view showing the general configuration of a blast hole drilling rig.

Referring to FIG. 1, the typical large blast hole drill rig consists of a carrier 2 mounted on crawlers 4 and having a cab 3, a mast 6 pivotably mounted on the deck of the carrier, outriggers or leveling jacks 7, and various on-deck machinery not shown here. The mast can be laid horizontally when the rig travels and pivoted upward by cylinders 8 to a vertical or angular operating position for drilling. A drill pipe engaging head 9 is mounted for travel up and down the mast 6, and is moved therealong by the hoist pull down system generally designated as 10.

In the following discussion, reference will be made to different operating modes. The term "drilling mode" will be used herein to mean that condition of the rig wherein the mast is raised to the preferred drilling angle, the outriggers are set against the ground to stabilize the rig, and the on-board equipment is functional for drilling. In this condition, the rig can operate to load and unload drill pipe, rotate the pipe and force it downward to drill and/or pull the drill string up from the drill hole. Thus "drilling mode" is meant to include all these operations. The term "leveling mode" will be used for that operative phase during which the outriggers 7 are being set to level and stabilize the working platform on the carrier. Finally, the term "traveling mode" will be used to denote both the situation in which the drill rig is traveling with the mast lowered, such as between job sites, and that in which it is traveling with the mast raised, such as between hole locations on a particular job.

Figure 2:
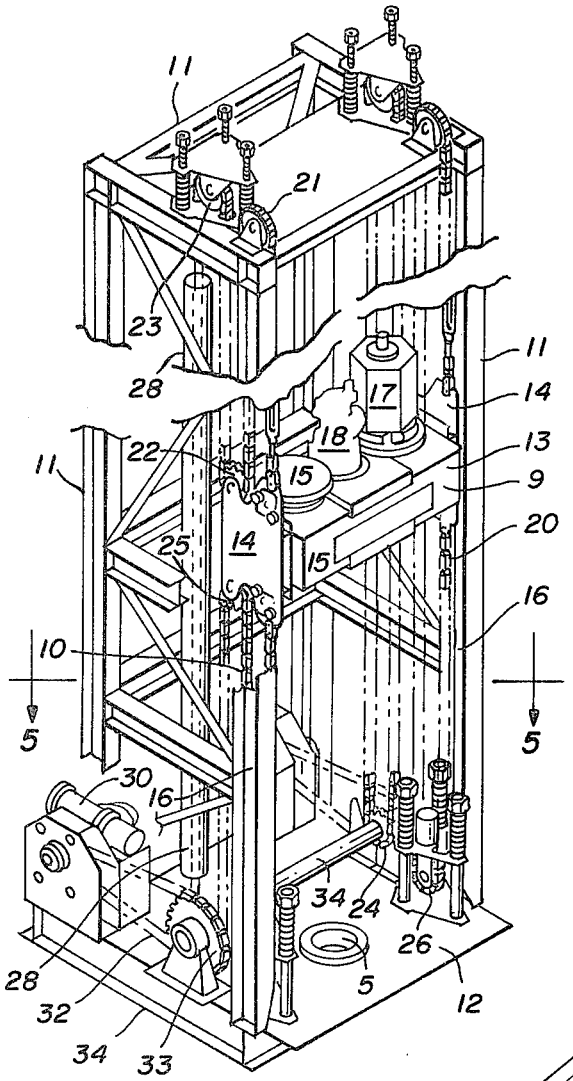
FIG. 2 is an isometric view of the mast and drill head for such a drill rig including a chain pull down system in accordance with the invention.

Referring now to FIG. 2, the mast 6 comprises a structural framework 11 extending upward from a base or drill table 12. The rotary drill head 9 includes a main housing 13 which has a bracket 14 attached at each side. Guide rollers 15 are rotatably mounted on the bracket 14 and positioned to engage the inner surfaces of vertically extending guide channels 16 which are an integral part of the mast framework 11. Thus, as the drill head travels up and down, the guide rollers 15 cooperates with the guide channels 16 to keep the head aligned with the bushing 5 in the drill table 12.

Figure 4:
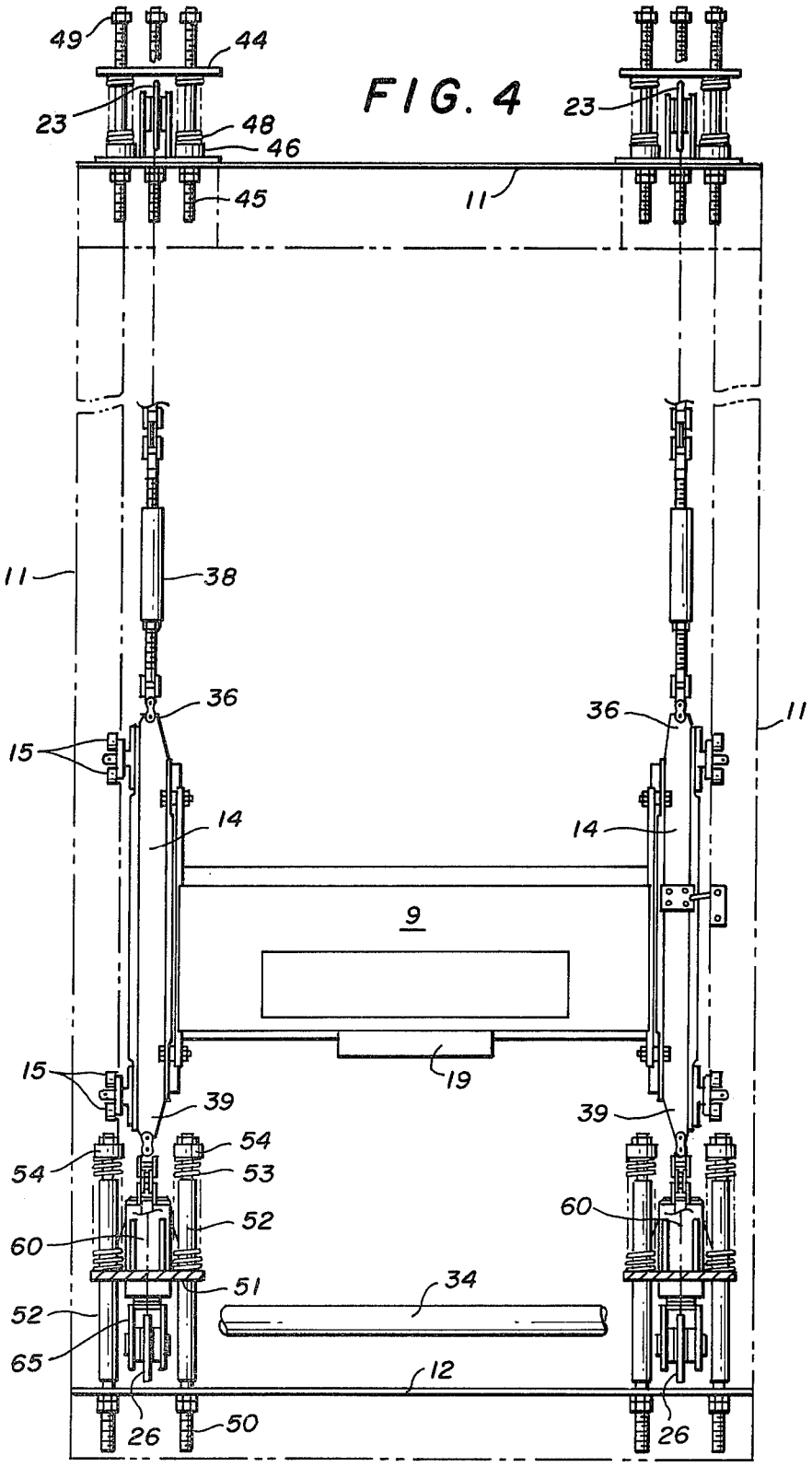
FIG. 4 is a front elevation view of the chain pull down system of FIG. 2.
Figure 5:
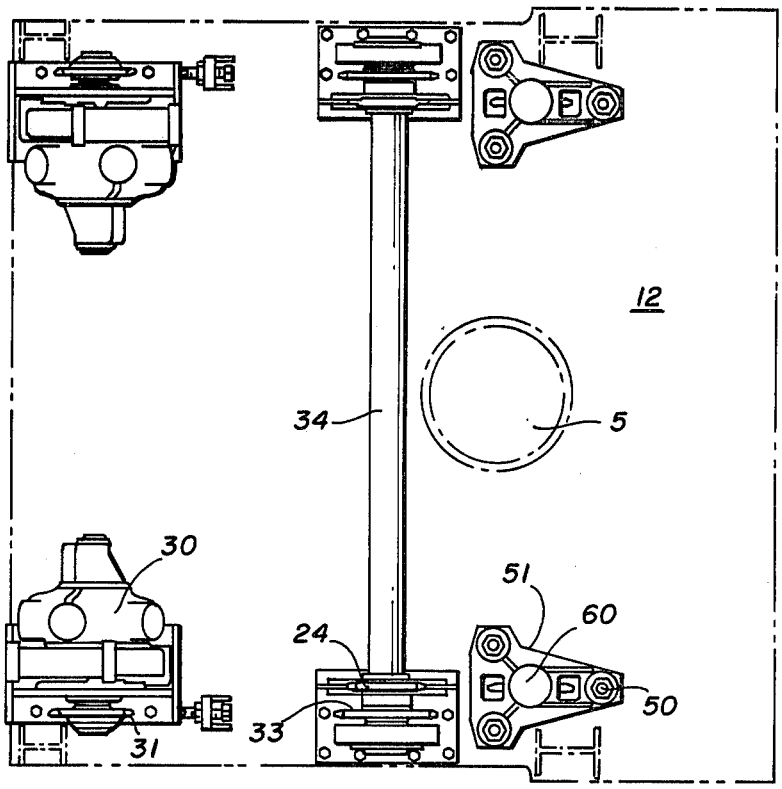
FIG. 5 is a plan view looking down from the line 5—5 in FIG. 2.

The drill head 9, as shown in FIG. 2, is sometimes called a "top head drive" because it includes in addition to a chuck for engaging the drill pipe, a drive means for rotating the drill pipe. The drive means comprises a DC or other variable speed motor 17 which engages reduction gears inside the housing 13 which in turn rotate a shaft on which a chuck is mounted. The chuck is not visible in FIG. 2, but is indicated generally by numeral 19 in FIG. 4. An air swivel joint 18 is mounted on the housing 13 and extends downward therethrough to communicate with the interior of the drill pipe to provide pressurized air through the drill string for the drilling operation. The swivel joint is typically connected to a source of pressurized air through flexible hoses not shown.

On some drill rigs, the means for rotating the drill pipe is located at the drilling platform, and the drill head consists of only a freely rotatable chuck for engaging the pipe to support its weight and apply downward force on it, and perhaps a rotary air joint. Therefore, as used herein, the term "drill head" is meant to include either of the foregoing types, or for that matter, any other type of traveling device whose primary purpose is to engage the drill pipe and apply thereto the downward thrusting or upward lifing force.

The drill head 9 is pulled up and down the mast 6 by a pair of hoist pull down chain systems 10 disposed on the opposite sides of the mast. The two systems are for present purposes identical and each comprises a long continuous chain 20 which is connected at one end to the top of the drill head and at its other end to the bottom of the drill head. In between its ends the chain 20 is reeved over idler sprockets 21 and 23 mounted at the top of the mast, drive sprockets 24 and idler sprockets 26 mounted at the bottom of the mast, and idler sprockets 22 and 25 connected to the bracket 14 at the side of the drill head housing. The chain 20 is driven by a drive mounted on the drill table which comprises a reversible hydraulic motor 30, drive sprocket 31, endless drive chain 32, reduction sprocket 33, shaft 34 and drive sprocket 24 which engages the chain 20. The two chain drives are synchronized through the commmon shaft 34. Depending on the selected direction of rotation of the motor 30, and consequently the drive sprocket 24, the chain 20 will either pull up on the drill head such as when pulling pipe out of the hole or down on it such as when drilling.

In some cases, chain guards are provided to protect the long spans of exposed chain 20. For the span between drive sprocket 24 and idler sprocket 23, a tubular guide 28 can be employed. However, because of the traveling drill head, the guards 29 for the other spans of chain must be open along at least one side.

Referring now to FIGS. 3–6, the chain pull down system on one side of the mast is discussed in more detail, it being understood that the system on the other side of the mast is essentially identical.

The chain 20 is a heavy-duty power transmission roller chain which, because of the mast height and the reeving involved, will typically be several hundred feet long. A chain of that length operating under the forces involved here will experience some permanent stretching over time. This growth is accommodated by providing a turnbuckle 38. For convenience, the turnbuckle is located near the connection of the chain 20 to the drill head 9.

The first end of the chain 20 is connected to upwardly extending lobe 36 of bracket 14 which is attached to the side of the drill head 9. The other end of the chain is attached to downwardly extending lobe 39 of bracket 14. Lobes 36 and 39 also serve as the mounting for the guide rollers 15. Idler sprockets 22 and 25 are respectively mounted on shafts journalled in clevises formed by lobes 37 and 38 which also extend from the bracket 14.

Idler sprocket 21 is mounted on a shaft 40 journalled in clevis 41 rigidly attached at the top of the mast 6. However, in order to compensate for the elastic stretching of the chain 20 which occurs when the drill head is under load, idler sprockets 23 and 26 are resiliently mounted to the mast structure. Sprocket 23 is mounted on shaft 42 journalled in clevis 43 affixed to floating plate 44. Three triangularly arranged guide rods 45 extend vertically up from the framework of mast 6. Each rod is held in place by collar 46 and nuts 47. Each rod is provided with a compression spring 48. Plate 44 has three holes such that it fits freely over the tripod arrangement of guide rods 45 and rests against the springs 48. Finally, restraining nuts 49 are provided to allow easy replacement of the floating mounting for sprocket 23.

The mounting for sprocket 26 is similarly resilient, but further includes auxiliary means for increasing the tension in the chain during the non-drilling modes of operation. Again, a tripod arrangement of three upwardly extending guide rods 50 is provided. Floating plate 51 has three triangularly arranged guide tubes 52 extending in both up and down directions, which tubes are internally sized to slide freely along the guide rods 50. The lower portion of the tubes serve as a stop to keep the sprocket from coming into contact with the drill table 12 while the upper portions serve as sleeves for compression springs 53 which are restrained between plate 51 and adjustable retaining collars 54 on the ends of rods 50.

The base 61 of a hydraulic cylinder 60 is rigidly affixed to floating plate 51 by gussets 63. The rod end 64 of the cylinder extends downwardly below the plate 51. Sprocket 26 is rotatably mounted on a shaft 66 journalled in clevis 65 which is connected to the rod end of cylinder 60. Cylinder 60 is single-acting with pressurized fluid provided via a flexible conduit 67 through port 68 at its base end.

When the cylinder 60 is in its relaxed state with no internal pressure against the piston 69, the opposing forces of the chain tension and the compression springs will hold the cylinder rod tightly retracted and the cylinder will act as a rigid member. In this condition, the mounting for sprocket 26 acts in the same way as that for sprocket 23 to absorb the directional slack and the elastic stretch in chain 20 due to the large load put on the drill head during the drilling mode. For instance, when the drilling head is bearing down on a drill pipe to further penetration of the drill hole the tensile load on the chain will be much larger between the end connected to lobe 39 and the drive sprocket 24. The resultant force against idler sprocket 26 will cause its mounting to compress against the springs 53. However, any slack in the chain 20 thus created, as well as stretching of chain 20 due to the high load will be taken-up by the action of the mounting for sprocket 23 which will be pushed tight against the chain by springs 48.

Conversely, when the drill head 9 is lifting a heavy drill string out of the hole, the tension in chain 20 will be increased between its connection to lobe 36 and drive sprocket 24. This will cause the mounting plate 44 for sprocket 23 to compress against the springs 48. Again, any slack or stretch in chain 20 will be taken-up by sprocket 26 whose mounting will be pressed downward by springs 53.

As described thus far, the pull down system can accommodate permanent growth in the chain by means of the turnbuckle 38 and elastic stretching of the chain by means of the cooperative action of the resiliently mounted idlers 23 and 26. However, when there is no load on the drilling head, the chain 20 becomes substantially relaxed because the only load on it is due to the dead weight of the drill head 9 and the force of the springs 48 and 53. The force of the springs will be at a minimum because their spring rate decreases as they reach full extension.

Accordingly, without load on the drill head there will be minimal tension in the chain 20 which, while not necessarily a problem as long as the rig stands still, becomes a problem when the rig moves or the mast is otherwise jostled. In this slackened condition, the long spans of chain 20 are free to slap around and into contact with the chain guards 28, 29 or other parts of the mast 6.

Thus, a means for correcting this condition when the drill rig is in the traveling or leveling modes is provided, and is here embodied in the single-acting hydraulic cylinder 60 which is interposed between the resilient mounting plate 51 and the idler sprocket 26. With this arrangement, when cylinder 60 is pressurized, it adds tension to the chain 20 through sprocket 26 which is cumulative with the tension due to the weight of the drilling head and the compression springs 48 and 53. Thus, the cylinder 60 can be actuated to substitute for the tensile load due to loading of the drill head during the drilling operation to keep the chain taut and prevent damage during the other operating modes of the drill rig.

It is a further and important feature of this unique arrangement that it lends itself to simple automatic actuation for the desired conditions. Refer now to the schematic diagram of FIG. 7. Pump 70 driven by motor 71 provides a source of pressurized hydraulic fluid. The boxes 72, 73 and 74 labeled "DRILL", "PROPEL", and "LEVEL" respectively represent the operative hydraulic circuits employed during those operational modes of the drill rig. Operator controlled valve 75 allows the operator to select between the "DRILL" mode or one of the other two operational modes. A second valve 76 provides the means to choose between the two non-drilling modes.

A hydraulic circuit for the chain tensioning cylinders 60 is also connected to the selector valve 75 on the opposite side of the circuit from the "DRILL" operation. This circuit includes pressure lines 81 to the two single-acting cylinders 60 (the second cylinder being for the matching chain pull-down system on the other side of the mast), a pressure relief valve 77 having upper and lower limits, and a pre-charged accumulator 78 to provide cushioning for the cylinders.

When the operator shifts valve 75 to select the "DRILL" operation, pressurized fluid passes to the circuit represented by box 72 while the other circuits are connected to the tank 79 at ambient pressure. It should be apparent that this is a simplified diagram intended to illustrate only one facet of the hydraulic system. In actuality some parts of the circuits for the "PROPEL" or "LEVEL" functions may be held at pressures above normal even during the "DRILL" mode. For example, the outriggers must be held under pressure during the "DRILL" mode. However, for our purpose here, it is enough to show that the valve 75 effects a choice between either the "DRILL" or some other mode.

When the operator shifts the valve 75 to select either the "PROPEL" or "LEVEL" mode, he automatically actuates the circuit for the auxiliary chain tensioning cylinders 60. Thus, the cylinder rods will extend and add additional tensile load to the chains 20 to keep them taut during these operational modes. Upon shifting back to the "DRILL" mode, the operator will automatically bleed the pressure from the cylinders 60, and their rods will retract due to the other tensile forces in the chains 20, which other forces are schematically represented by the spring-like figures 80.

Figure 3:
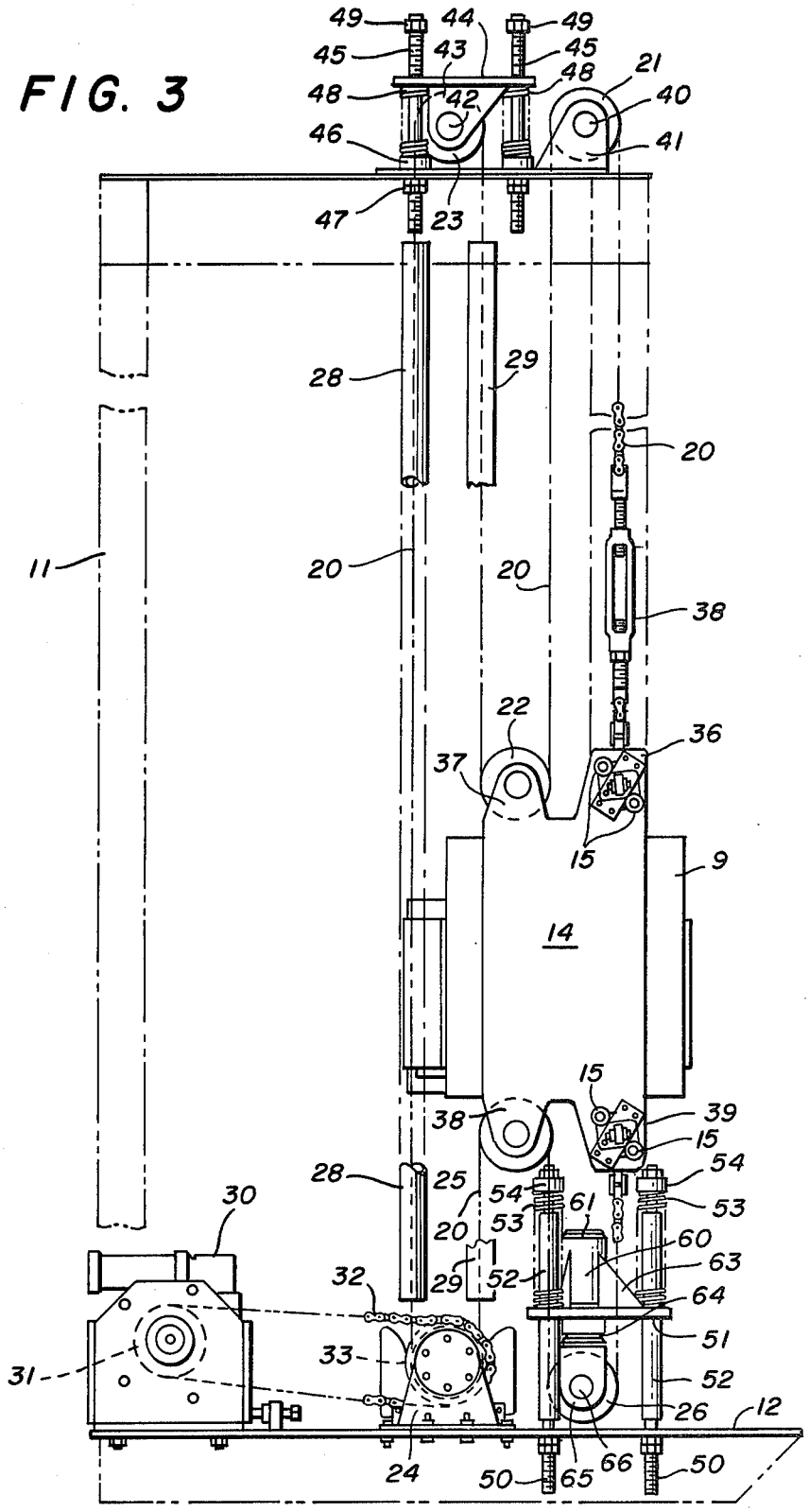
FIG. 3 is a side elevation of the chain-pull system embodying the invention.
Figure 6:
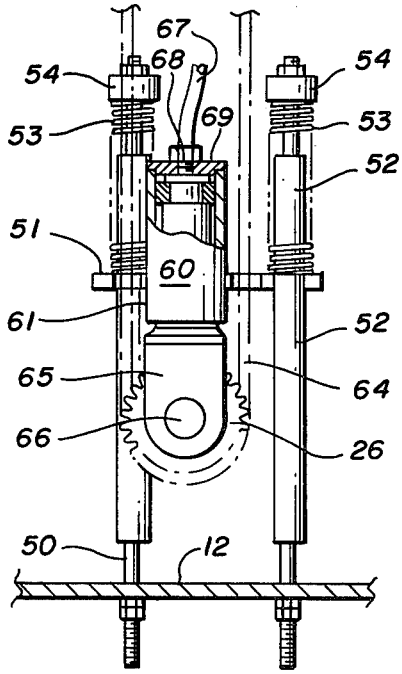
FIG. 6 is an elevational view, partially in section, of the auxiliary tensioning means of the chain pull down system of FIG. 2.
Figure 7:
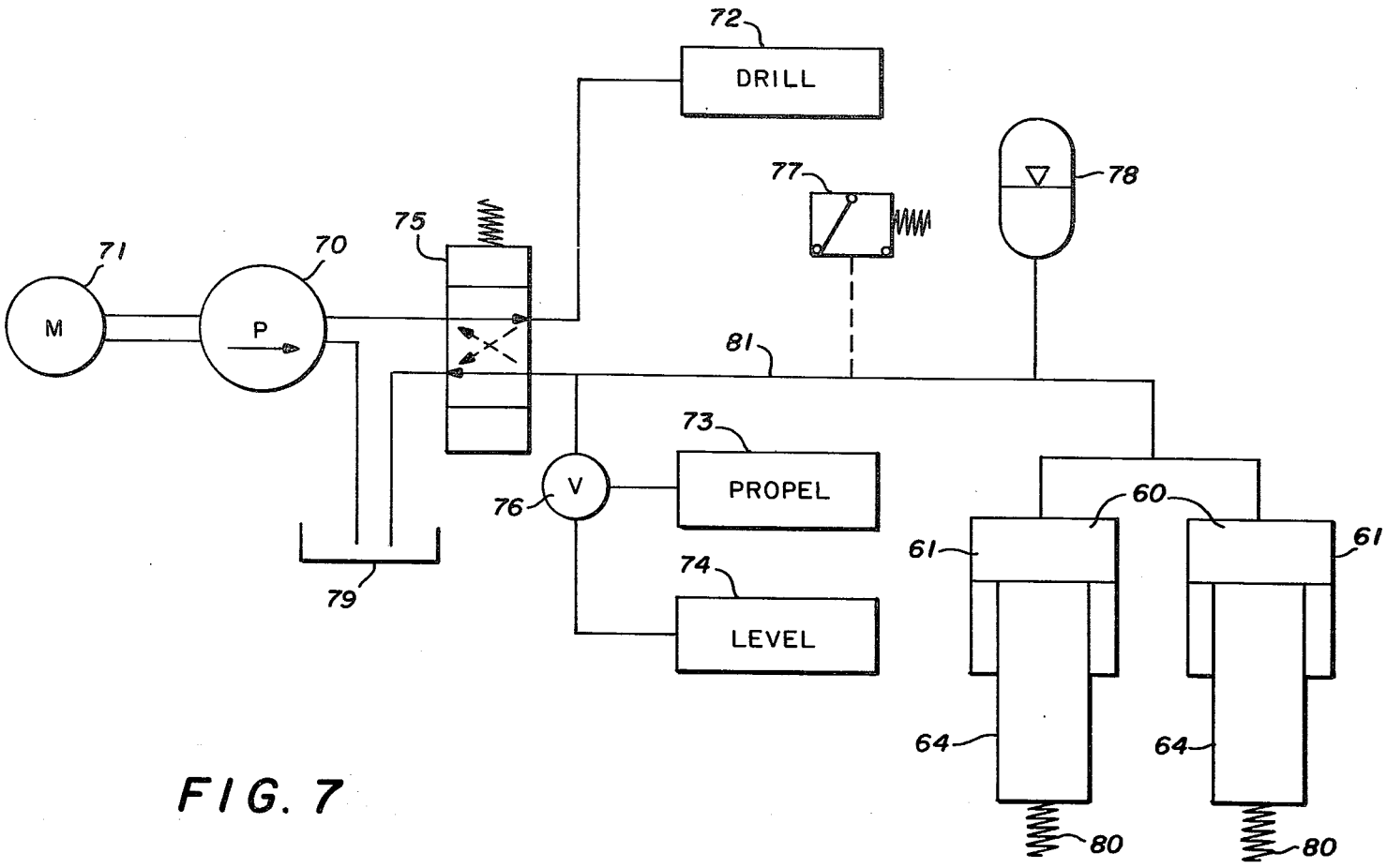
FIG. 7 is a schematic diagram showing the automatic tie-in of the auxiliary tensioning means to the operator's selection of operating modes for the drilling rig.

Thus, the interposing of single acting hydraulic cylinder 60 between idler sprocket 26 and its resilient mounting as shown in FIGS. 3 and 6, together with a simple modification to the hydraulic system of the drilling rig as illustrated in FIG. 7, provides a chain hoist pull down system which can automatically adjust the tension in the chain to compensate for removal of the principal working load to keep the chain taut during selected operational modes of the drill rig.

The embodiments of the invention in which an exclusive property or privilege is claimed are defined as follows:

1. A chain-type hoist pull down system for a blast hole drill having a mast extending angularly upward from an integral drill table and a drill pipe engaging head mounted for travel along the mast, said system comprising:

a continuous chain connected at one end to the drill head to pull upward thereon and connected at its other end to the drill head to pull downward thereon, said chain being reeved intermediate its ends around idler sprockets and a drive sprocket connected to said mast, at least one of said idler sprockets being resiliently connected to said mast and effective to provide tension in said chain;

means suspended between said one idler sprocket and its resilient mounting which is selectively actuable to increase the tension in said chain; and means mounted on said drill for rotating said drive sprocket in either direction.

2. A chain-type hoist pull down system as recited in claim 1, wherein said means for increasing the chain tension is an extensible member.

3. A chain-type hoist pull down system as recited in claim 1, wherein said means for increasing the chain tension is a fluid pressure actuated cylinder.

4. A chain-type hoist pull down system as recited in claim 1, wherein the resilient mounting for said one idler sprocket comprises a plate slidably mounted on parallel rods connected to said drill table and having means holding said plate against compression springs disposed between said plate and said drill table.

5. A chain-type hoist pull down system as recited in claim 4, wherein said parallel rods are triangularly arranged and said compression springs are mounted in sleeved fashion on said rods.

6. A chain-type hoist pull down system as recited in claim 4, wherein said means for increasing the chain tension is a pressurized fluid actuatable cylinder having a base fixedly mounted to said slidably mounted plate and a rod end fitted with a clevis for holding said idler sprocket.

7. A chain-type hoist pull down system as recited in claim 1, wherein said means for increasing the chain tension is a single acting hydraulic cylinder.

8. A chain-type hoist pull down system as recited in claim 1, wherein at least one other idler sprocket engaging said chain is resiliently mounted to said mast.

9. A chain-type hoist pull down system as recited in claim 1, wherein said means for tensioning said chain is automatically actuated when the drill operator selects the propel or leveling functions of the drill rig under conditions in which there is no work load on the drill head to thereby increase the tension in the chain and keep it taut during said propel or leveling operation.

10. A chain-type hoist pull down system for a blast hole drill rig having an angularly upwardly extending mast and a drill pipe engaging head mounted for travel up and down said mast, said system comprising:

a continuous roller chain connected at one end to the drill head to pull upward thereon and at its other end to the drill head to pull downward thereon, said chain passing intermediate its ends around at least one idler sprocket mounted at the top of said mast and another idler sprocket mounted at the bottom of said mast, at least one of said idler sprockets being mounted in a spring loaded mounting whereby said sprocket imparts tension to the chain;

means mounted on said drill rig for driving said chain in either direction; and auxiliary tensioning means connected to said spring mounted idler and actuable in response to the drill rig operator's selection of an operating mode to increase the tension in said chain during certain selected operating modes of the drill rig.

11. In a chain-type hoist pull down system for a blast hole drill having a continuous chain connected at one end to a drill head for pulling upward thereon and connected at its other end to said drill head for pulling downward thereon at least one resiliently mounted idler sprocket for providing tension in said chain, and a drive for moving said chain in either direction, the improvement comprising:

fluid actuable extensible means connected between said one idler sprocket and its resilient mounting, said means being selectively actuable to increase the tension in said chain.

12. The improvement in a chain-type hoist pull down system as recited in claim 11 wherein said extensible means is a hydraulic cylinder having a base connected to said resilient mounting and an extensible rod connected to said idler sprocket.

* * * * *